US009796566B2

(12) United States Patent
Matsuda et al.

(10) Patent No.: US 9,796,566 B2
(45) Date of Patent: Oct. 24, 2017

(54) BOOM EXTENSION AND CONTRACTION MECHANISM FOR CRANE APPARATUS

(71) Applicant: TADANO LTD., Takamatsu, Kagawa (JP)

(72) Inventors: Masanori Matsuda, Takamatsu (JP); Kazu Nagahama, Takamatsu (JP)

(73) Assignee: TADANO LTD., Kagawa (JP)

( * ) Notice: Subject to any disclaimer, the term of this patent is extended or adjusted under 35 U.S.C. 154(b) by 0 days.

(21) Appl. No.: 14/457,885

(22) Filed: Aug. 12, 2014

(65) Prior Publication Data

US 2015/0060385 A1 Mar. 5, 2015

(30) Foreign Application Priority Data

Aug. 30, 2013 (JP) ..... 2013-179061

(51) Int. Cl.
*B66C 23/70* (2006.01)

(52) U.S. Cl.
CPC ..... *B66C 23/705* (2013.01); *B66C 23/708* (2013.01)

(58) Field of Classification Search
CPC ..... B66C 23/705; B66C 23/708
See application file for complete search history.

(56) References Cited

U.S. PATENT DOCUMENTS 2,310,887 A * 2/1943 Andersen ..... F41H 7/00 244/2
3,638,806 A * 2/1972 Hippach ..... B66C 23/703 212/231
3,657,969 A * 4/1972 Wirkus ..... F15B 11/20 212/349
3,701,439 A * 10/1972 Lado ..... B66C 13/18 212/264

(Continued)

FOREIGN PATENT DOCUMENTS

JP 2002293494 A 10/2002
JP 2002332194 A * 11/2002

(Continued)

OTHER PUBLICATIONS

Dec. 10, 2014 Extended Search Report issued in European Application No. 14181773.4.

(Continued)

*Primary Examiner* — Emmanuel M Marcelo
*Assistant Examiner* — Michael Gallion
(74) *Attorney, Agent, or Firm* — Oliff PLC

(57) ABSTRACT

A boom extension and contraction mechanism for a crane apparatus includes: a flow passage switching mechanism that switches a flow passage of the hydraulic oil between the cylinder-to-boom connection switching cylinder side and the boom member connection switching cylinder side; a hose reel configured to reel out a hydraulic hose as a telescopic cylinder is extending, and to reel off the hydraulic (Continued)

hose as the telescopic cylinder is contracting; a cable used to supply power and transmit a signal between a swivel base and a boom; and a cord reel configured to reel out the cable as the telescopic cylinder is extending and to reel off the cable as the telescopic cylinder is contracting. The code reel and the hose reel are arranged on the base in a direction in which the boom extends and contracts.

1 Claim, 8 Drawing Sheets

(56) References Cited

U.S. PATENT DOCUMENTS 3,770,138 A * 11/1973 Chalupsky ..... B66C 23/708 212/349
3,771,668 A * 11/1973 Johnston ..... B66C 23/90 212/264
3,777,629 A * 12/1973 Johnston ..... F15B 21/08 212/231
3,792,780 A * 2/1974 Spain ..... B66C 23/90 212/278
3,822,834 A * 7/1974 Fjarlie ..... H02G 11/02 242/386
3,876,045 A * 4/1975 Knarreborg ..... B65H 75/40 191/12.2 R
4,036,372 A * 7/1977 Rao ..... B66C 23/708 212/230
4,219,121 A * 8/1980 McPeak ..... B66C 23/88 212/281
4,350,255 A * 9/1982 Blase ..... B66C 23/705 212/296
4,395,192 A * 7/1983 Schlafly ..... E02F 3/286 212/349
4,434,902 A * 3/1984 Goode ..... B66C 23/705 212/349
4,436,190 A * 3/1984 Wentzell ..... B65H 75/4449 191/12.2 R
4,954,041 A * 9/1990 Dahlquist ..... B66F 9/07559 212/264
4,993,564 A * 2/1991 Blatt ..... B23Q 1/0009 173/184
5,501,346 A * 3/1996 Wimmer ..... B66C 23/54 212/231
5,628,416 A * 5/1997 Frommelt ..... B66C 23/705 212/292
5,660,495 A * 8/1997 Atsukawa ..... F16B 7/10 248/405
5,731,987 A * 3/1998 Strong ..... B66C 23/905 212/347
5,769,251 A * 6/1998 Wada ..... B66C 13/18 212/231
5,877,693 A * 3/1999 Eyler ..... B66C 23/905 212/276
6,029,559 A * 2/2000 Barthalow ..... B66C 23/705 91/167 R
6,062,404 A * 5/2000 Erdmann ..... B66C 23/708 212/292
6,216,895 B1 * 4/2001 Erdmann ..... B66C 23/708 212/292
6,474,486 B1 * 11/2002 Baraniak ..... B66C 23/705 212/292
2001/0052506 A1 * 12/2001 Richter ..... B66C 23/708 212/177
2003/0127408 A1 * 7/2003 Schneider ..... B66C 23/905 212/281
2005/0098524 A1 * 5/2005 Irsch ..... B66C 13/18 212/300
2006/0180562 A1 * 8/2006 Rohr ..... B66C 13/40 212/71
2006/0180563 A1 * 8/2006 Knight ..... B66C 23/90 212/299
2010/0187194 A1 * 7/2010 Schuermann ..... B66C 23/708 212/292
2010/0213154 A1 * 8/2010 Krebs ..... B66C 23/708 212/292
2012/0074089 A1 * 3/2012 Willim ..... B66C 23/708 212/348
2014/0158657 A1 * 6/2014 Knecht ..... B66C 23/36 212/299
2015/0008207 A1 * 1/2015 Habe ..... B66C 23/705 212/350
2015/0041422 A1 * 2/2015 Kaupert ..... B66C 23/708 212/292
2015/0128735 A1 * 5/2015 Klein ..... B66C 23/708 74/110

FOREIGN PATENT DOCUMENTS

JP A-2002-332194 11/2002
JP 2004-244170 A 9/2004
JP 2004244196 A 9/2004
JP 2010184754 A 8/2010
JP EP 2388228 A1 * 11/2011 ..... B66C 23/705

OTHER PUBLICATIONS

May 2, 2017 Office Action issued in Japanese Patent Application No. 2013-179061.

* cited by examiner

BOOM EXTENSION AND CONTRACTION MECHANISM FOR CRANE APPARATUS

CROSS-REFERENCES TO RELATED APPLICATIONS

This application claims the benefit of Japanese Patent Application No. 2013-179061, filed Aug. 30, 2013, which is incorporated herein by reference.

BACKGROUND

1. Technical Field

The present invention relates to a boom extension and contraction mechanism for a crane apparatus including a boom that is extended and contracted by one hydraulic cylinder.

2. Related Art

Conventionally, there has been known this sort of boom extension and contraction mechanism that includes a boom with a plurality of boom members and one telescopic cylinder; the telescopic cylinder allows the boom to extend and contract by shifting next boom members in front of respective ones with respect to the boom members other than a top boom member; and one of a cylinder rod and a cylinder tube of the telescopic cylinder is connected to the bottom boom member (see, for example, Patent Literature 1).

The boom extension and contraction mechanism includes: a cylinder-to-boom connection mechanism that can connect and disconnect between the other of the cylinder rod and the cylinder tube, and the boom members other than the bottom boom member; and a boom member connection mechanism that can connect and disconnect between the boom members next to one other.

The cylinder-to-boom connection mechanism and the boom member connection mechanism of the boom extension and contraction mechanism are driven by respective hydraulic double acting cylinders. Therefore, two hydraulic hoses to supply and discharge hydraulic oil are required for each of the hydraulic double acting cylinders that drive the cylinder-to-boom connection mechanism and the boom member connection mechanism, respectively. The double acting cylinders are provided in the other of the cylinder rod and the cylinder tube of the telescopic cylinder, and therefore change in their positions according to the telescopic motion of the telescopic cylinder. The hydraulic hose connected to each of the double acting cylinders is wound around a hose reel provided on a swivel base to which the base end of the boom is connected, and therefore is reeled out and off according to the telescopic motion of the boom. In addition, the hydraulic hose connected to each of the double acting cylinders is a twin hose having a pair of hydraulic oil passages integrally formed with each of the double acting cylinders.

The boom extension and contraction mechanism further includes a boom detection sensor that detects which of the boom members is connected to the telescopic cylinder. Therefore, a communication cable is required to transmit a detection signal from the boom detection sensor. The boom detection sensor is provided in the other of the cylinder rod and the cylinder tube of the telescopic cylinder, and therefore changes in its position with respect to the base end of the boom according to the telescopic motion of the telescopic cylinder. Therefore, the communication cable wound around a cord reel provided on the swivel base like the hose reel is reeled out and off according to the telescopic motion of the boom.

This boom extension and contraction mechanism needs two hose reels around which the pair of hydraulic hoses is wound, and also needs a cord reel around which the communication cable is wound. As a result, the number of parts is increased and the structure of the based end of the boom is complicated.

Moreover, the twin hose is normally wound around the hose reel outward in the radial direction in order to make the fleet angle a predetermined angle or lower in terms of the relationship with the sheave that guides the twin hose. Therefore, the hose reel around which the twin hose is wound is increased in size in the radial direction. Consequently, when mounted on the swivel base, the hose reel substantially protrudes backward from the swivel base. As a result, the counter weight mounted on the back of the swivel base protrudes further to increase the angle of traverse, and therefore the working efficiency may be deteriorated.

To solve this problem with an increase in the angle of traverse of the counter weight, a boom extension and contraction mechanism is expected which includes the cylinder-to-boom connection mechanism and the boom member connection mechanism driven by hydraulic single acting cylinders, respectively, and also includes a hydraulic oil passage to supply hydraulic oil to each of the single acting cylinders, which is provided in each of the cylinder tube and the cylinder rod of the telescopic cylinder. With this boom extension and contraction mechanism, the hydraulic oil passage to supply hydraulic oil to each of the single acting cylinders extends and contracts according to the telescopic motion of the telescopic cylinder. Therefore, merely the inlet/outlet of the hydraulic oil passage provided in the telescopic cylinder is connected to each of the single acting cylinders, so that a hose reel is not needed.

Patent literature 1: Japanese Patent Application Laid-Open No. 2002-332194

Here, with the boom extension and contraction mechanism without a hose reel, it is possible to reduce the angle of traverse in the back of the swivel base. However, since the hydraulic oil passage is provided in the telescopic cylinder, the structure is complicated, and therefore it is not easy to address a failure that occurs in the telescopic cylinder.

SUMMARY

It is therefore an object of the present invention to provide a simple boom extension and contraction mechanism for a crane apparatus that can reduce the angle of traverse in the back of the swivel base.

To achieve the above-described object, the boom extension and contraction mechanism according to the present invention includes: a boom including a plurality of boom members, the boom extending and contracting by shifting next boom members in front of respective ones with respect to the boom members other than a top boom member; a base configured to support a base end of a bottom boom member; a telescopic cylinder including a cylinder rod and a cylinder tube, one of the cylinder rod and the cylinder tube being connected to the bottom boom member to extend and contract the boom; a cylinder-to-boom connection mechanism configured to be able to connect and disconnect between the other of the cylinder rod and the cylinder tube and the boom members other than the bottom boom member; a boom member connection mechanism configured to be able to connect between the boom members next to one another and release the boom members from being connected to one another; a cylinder-to-boom connection switching cylinder configured to allow the cylinder-to-boom connection mechanism to perform one of a connecting operation and a disconnecting operation between the telescopic cylinder and a boom member by supplying hydraulic oil, and to allow the cylinder-to-boom connection mechanism to perform the other of the connecting operation and the disconnecting operation between the telescopic cylinder and the boom member by stopping supplying the hydraulic oil; a boom member connection switching cylinder configured to allow the boom member connection mechanism to perform one of a connecting operation and a disconnecting operation between the boom members next to one another by supplying the hydraulic oil, and to allow the boom member connection mechanism to perform the other of the connecting operation and the disconnecting operation between the boom members next to one another by stopping supplying the hydraulic oil; a hydraulic hose configured to supply the hydraulic oil from the base side to the cylinder-to-boom connection switching cylinder and the boom member connection switching cylinder; a flow passage switching mechanism configured to switch a flow passage of the hydraulic oil supplied via the hydraulic hose between the cylinder-to-boom connection switching cylinder side and the boom member connection switching cylinder side; a hose reel configured to reel out the hydraulic hose as the telescopic cylinder is extending, and to reel off the hydraulic hose as the telescopic cylinder is contracting; a cable used to supply power from the base side to equipment provided in the other of the cylinder rod and the cylinder tube of the telescopic cylinder, and to transmit a signal from the equipment to the base side; and a cord reel configured to reel out the cable as the telescopic cylinder is extending and to reel off the cable as the telescopic cylinder is contracting, wherein the hose reel and the cord reel are arranged on the base in a direction in which the boom extends and contracts.

By this means, it is possible to supply hydraulic oil for driving the cylinder-to-boom connection switching cylinder and the boom member connection switching cylinder by one hydraulic hose. Therefore, the size of the hose reel is increased in the direction of the rotating axis while reducing the size of the hose reel in the radial direction, so that it is possible to reduce the dimension for which the hose reel protrudes from the back of the swivel base. Moreover, the hose reel and the cord reel are arranged on the swivel base in the direction in which the boom extends and contracts, and therefore it is possible to place the hydraulic hose and the cable near one another and extend them to the other of the cylinder rod and the cylinder tube.

With the present invention, it is possible to increase the dimension of the hose reel in the direction of the rotating axis while reducing the dimension in the radial direction. Also, it is possible to reduce the dimension for which the hose reel protrudes from the back of the swivel base, and therefore to reduce the angle of traverse in back of the swivel base, with a simple structure. Moreover, it is possible to place the hydraulic hose and the cable near one another and extend them to the other of the cylinder rod and the cylinder tube. Therefore, it is possible to reduce the size of the boom in the width direction.

DESCRIPTION OF EXEMPLARY EMBODIMENTS

FIGS. 1 to 8 show an embodiment of the present invention. With the present embodiment, a mobile crane 1 will be described as a crane apparatus having a boom extension and contraction mechanism according to the present invention.

Figure 1:
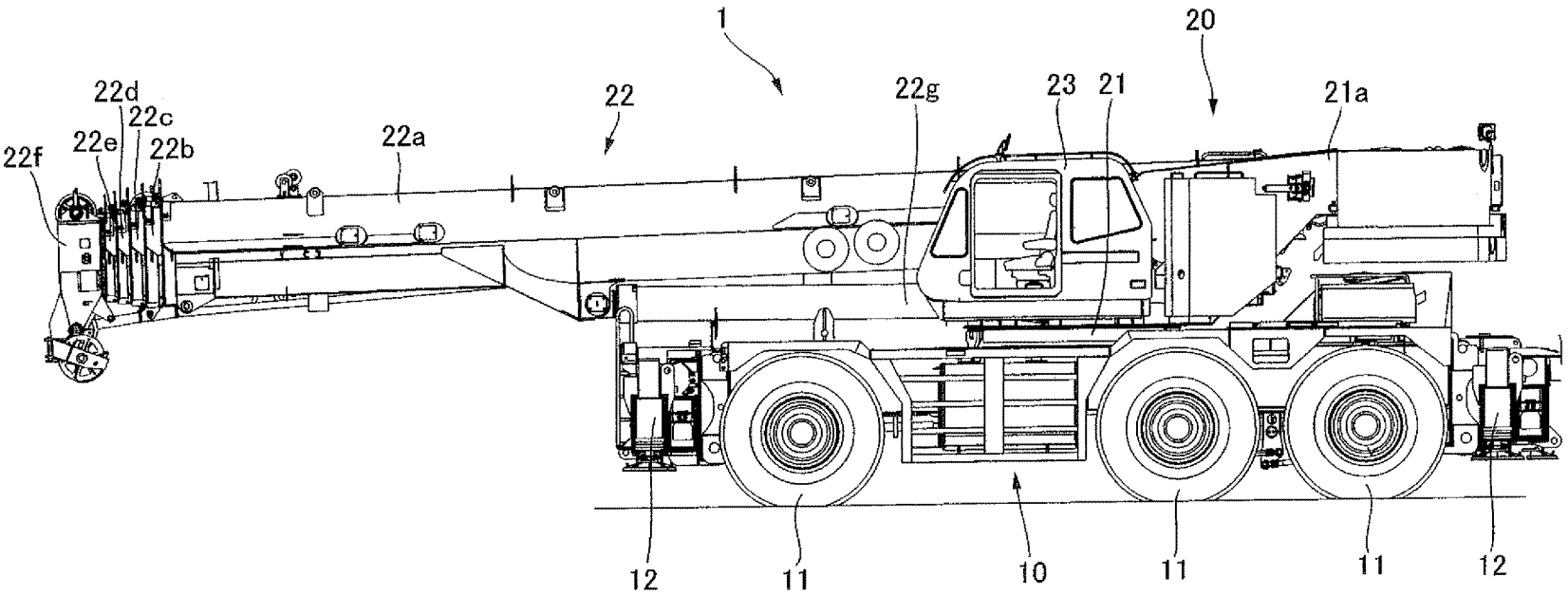
FIG. 1 is a side view showing a mobile crane according to one embodiment of the present invention.

As shown in FIG. 1, the mobile crane 1 includes a vehicle 10 that runs on the ground, and a crane apparatus 20 as an operation part.

The vehicle 10 has wheels 11 and runs by an engine (not shown) as a power source. In addition, outriggers 12 are provided on the right and left sides of the front part of the vehicle 10 and also on the right and left sides of the rear part of the vehicle 10 to prevent the vehicle 10 from overturning and support the vehicle 10 stably when the crane is working. Each outrigger 12 is movable outward in the width direction and also extendable downward by a hydraulic jack cylinder (not shown). The bottom ends of the outriggers 12 contact the ground to support the vehicle 10 on the ground stably.

The crane apparatus 20 includes a swivel base 21 that is pivotably provided in the center part of the vehicle 10 in the longitudinal direction and is configured to be able to swivel on a horizontal plane; a boom 22 provided to be able to rise and down with respect to the swivel base 21 and to be able to extend and contract; and a cabin 23 provided in the front part of the swivel base 21 to run the vehicle 10 and operate the crane apparatus 20 to work.

The swivel base 21 is configured to be able to swivel with respect to the vehicle 10 by means of a ball bearing or roller bearing swivel support. The swivel base 21 is driven by a hydraulic swivel motor (not shown).

The boom 22 is constituted by a plurality of boom members 22*a*, 22*b*, 22*c*, 22*d*, 22*e* and 22*f* and formed as a telescopic boom in such a manner that the boom members 22*a*, 22*b*, 22*c*, 22*d*, and 22*e* can accommodate the respective next boom members 22*b*, 22*c*, 22*d*, 22*e* and 22*f* in front of the boom members 22*a*, 22*b*, 22*c*, 22*d*, and 22*e*. The boom 22 according to the preset embodiment is constituted by six boom members, the bottom boom member 22*a*, the second boom member 22*b*, the third boom member 22*c*, the fourth boom member 22*d*, the fifth boom member 22*e*, and the top boom member 22*f*, which are arranged in the order from the base end of the boom 22.

The base end of the bottom boom member 22*a* is swingably connected to a bracket 21*a* of the swivel base 21. A hydraulic luffing cylinder 22*g* is connected between the bottom boom member 22*a* and the bracket 21*a*, and extends and contracts to allow the boom 22 to rise and down.

A boom extension and contraction mechanism 30 allows the boom 22 to extend and contract.

Figure 2:
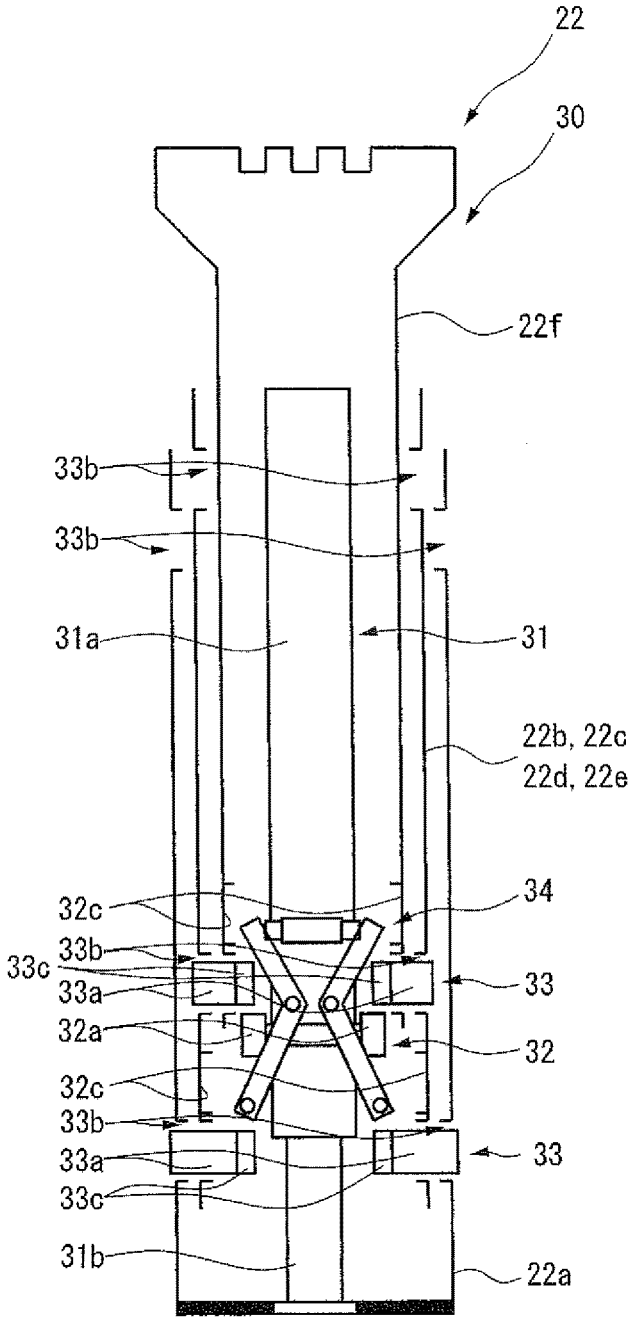
FIG. 2 is a schematic view showing a boom and a boom extension and contraction mechanism.
Figure 3:
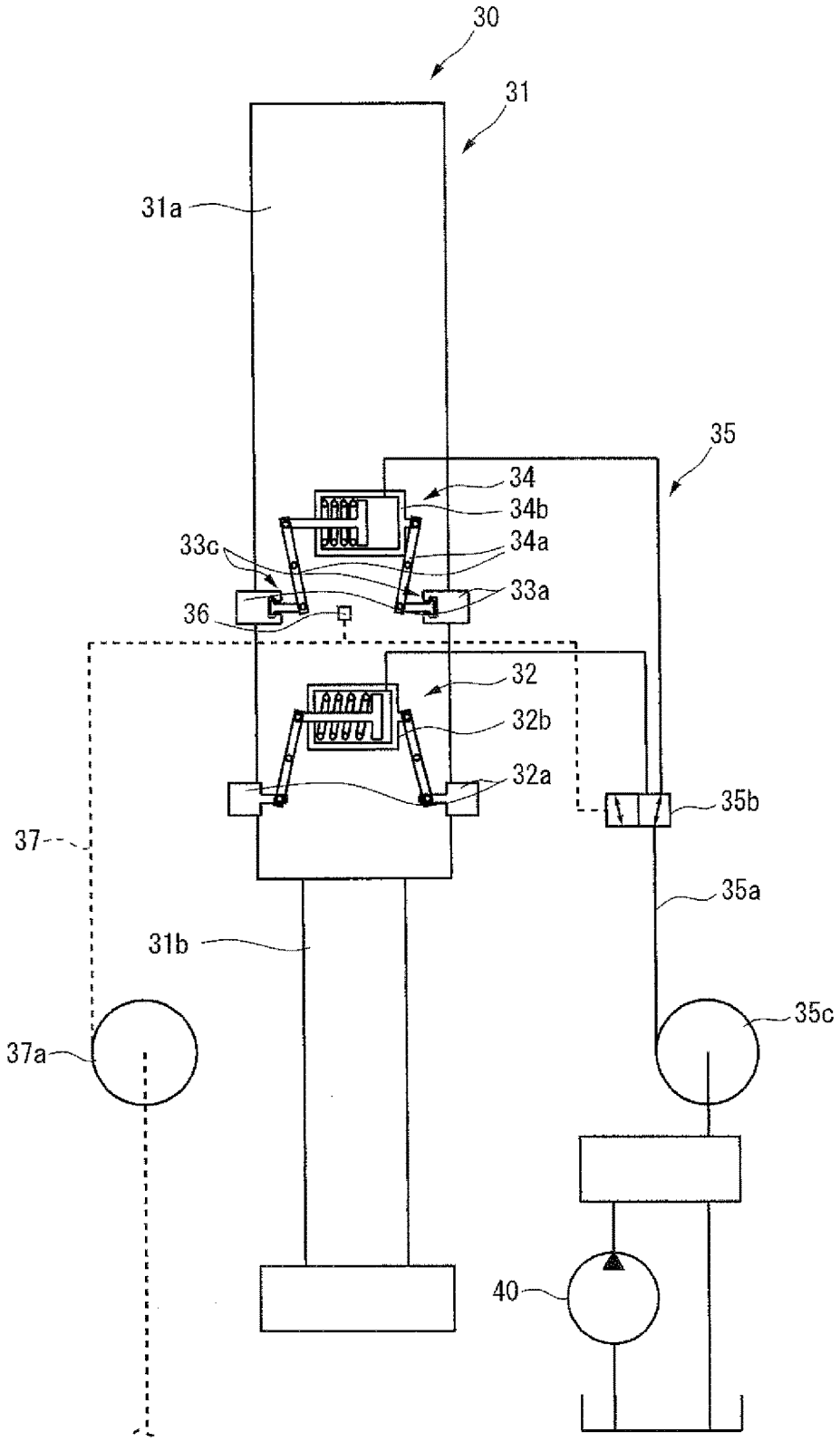
FIG. 3 is a schematic view showing the boom extension and contraction mechanism.

As shown in FIGS. 2 and 3, the boom extension and contraction mechanism includes: a telescopic cylinder 31 that shifts the boom members 22*b*, 22*c*, 22*d*, 22*e* and 22*f* other than the bottom boom member 22*a*; a cylinder-to-boom connection mechanism that removably connects between the telescopic cylinder 31 and the boom members 22*b*, 22*c*, 22*d*, 22*e* and 22*f* other than the bottom boom member 22*a*; a plurality of boom member connection mechanism 33 that removably connect between the boom members 22*a*, 22*b*, 22*c*, 22*d* and, 22*e* and respective next ones, the boom members 22*b*, 22*c*, 22*d*, 22*e* and 22*f* in front of the boom members 22*a*, 22*b*, 22*c*, 22*d* and 22*e*; and a boom member disconnection mechanism 34 that disconnects between the boom members 22*a*, 22*b*, 22*c*, 22*d*, and 22*e* and respective next ones, the boom members 22*b*, 22*c*, 22*d*, 22*e* and 22*f* in front of the boom members 22*a*, 22*b*, 22*c*, 22*d* and 22*e*.

As shown in FIG. 2, the telescopic cylinder 31 includes a cylinder tube 31*a* and a cylinder rod 31*b*. The front end of the cylinder rod 31*b* is connected to the base end of the bottom boom member 22*a* in the bottom boom member 22*a*. By supplying the hydraulic oil discharged from a hydraulic pump 40, the cylinder tube 31*a* moves with respect to the cylinder rod 31*b* in the direction in which the boom 22 extends and contracts.

As shown in FIG. 3, the cylinder-to-boom connection mechanism 32 is provided on the outer periphery of the cylinder tube 31*a* the telescopic cylinder 31. The cylinder-to-boom connection mechanism 32 includes a pair of cylinder pins 32*a* that can engage the boom members 22*b*, 22*c*, 22*d*, 22*e* and 22*f* other than the bottom boom member 22*a*; and a cylinder-to-boom connection switching cylinder 32*b* that releases the pair of cylinder pins 32*a* from engaging the boom members 22*b*, 22*c*, 22*d*, 22*e* and 22*f* other than the bottom boom member 22*a*.

As shown in FIG. 2, a cylinder pin engagement part 32*c* formed in a concave shape is provided in the base end side of each of the boom members 22*b*, 22*c*, 22*d*, 22*e* and 22*f* other than the bottom boom member 22*a*. The cylinder pin 32*a* can engage each of the cylinder pin engagement part 32*c*.

The pair of cylinder pins 32*a* can move in the radial direction of the cylinder tube 31*a*. When being moved outward in the radial direction, the pair of cylinder pins 32*a* engages the cylinder pin engagement parts 32*c*. Meanwhile, when being moved inward in the radial direction, the pair of cylinder pins 32 is released from engaging the cylinder pin engagement parts 32*c*.

The cylinder-to-boom connection switching cylinder 32*b* is a spring return type of single acting cylinder that biases the cylinder pins 32*a* in the direction in which the cylinder pins 32*a* engage the cylinder pin engagement parts 32*c*. BY supplying the hydraulic oil, the cylinder-to-boom connection switching cylinder 32*b* releases the cylinder pins 32*a* from engaging with the cylinder engagement parts 32*c*.

As shown in FIG. 2, each of the boom member connection mechanisms 33 includes: a boom member connection pin 33*a* provided in each of the boom members 22*b*, 22*c*, 22*d*, 22*e* and 22*f* in the front end side of the boom 22; and a pin engagement hole 22*b* provided in each of the boom members 22*a*, 22*b*, 22*c*, 22*d* and 22*e* in the base end side of the boom 22, which can engage the boom member connection pin 33*a*.

As shown in FIG. 2, the boom member connection pin 33*a* is biased in the direction in which the front end of the boom member connection pin 33*a* engages the pin engagement hole 33*b* of the next boom member 22*a*, 22*b*, 22*c*, 22*d*, and 22*e* in the base end side. A lever engagement part 33*c* to engage a disconnection lever 33*c* of the boom member disconnection mechanism 34 described later is provided on the boom member connection pin 33*a*.

As shown in FIG. 2, the pin engagement holes 33*b* are provided for the base end sides and front end sides of the boom members 22*a*, 22*b*, 22*c*, 22*d* and 22*e*. The pin engagement holes 33*b* are provided in positions to meet the protrusion length of the boom members 22*b*, 22*c*, 22*d*, 22*e*, and 22*f* from the respective next boom members 22*a*, 22*b*, 22*c*, 22*d*, and 22*f* in front of the boom members 22*a*, 22*b*, 22*c*, 22*d*, and 22*e*, in addition to the base end sides and front end side of the boom members 22*a*, 22*b*, 22*c*, 22*d* and 22*e*.

As shown in FIG. 3, the boom member disconnection mechanism 34 is provided on the outer periphery of the cylinder tube 31*a* of the telescopic cylinder 31, and has a disconnection lever 34*a* that can engage the lever engagement part 33*c* for any boom member connection pin 33*a*, and a boom member connection switching cylinder 34*b* that activates the disconnection lever 34*a*.

The disconnection lever 34*a* can engage the lever engagement part 33*c* of the boom member connection pin 33*a* at the position at which the pair of cylinder pins 32*a* engages the cylinder pin engagement parts 32*c*. In addition, by driving the boom member connection switching cylinder 34*b*, the disconnection lever 34*a* releases the boom member connection pins 33*a* from connecting between the boom members.

The boom member connection switching cylinder 34*b* is a spring return type of single acting cylinder. With the supply of the hydraulic oil, the boom member connection switching cylinder 34*b* activates the disconnection lever 34*a* in the direction in which the boom member connection pins 33*a* are released from connecting between the boom members.

The boom extension and contraction mechanism 30 further includes a hydraulic oil supply circuit 35 for supplying the cylinder-to-boom connection switching cylinder 32*b* and the boom member connection switching cylinder 34*b* with the hydraulic oil discharged from the hydraulic pump 40.

As shown in FIG. 3, the hydraulic oil supply circuit 35 includes a hydraulic hose 35*a* for flowing the hydraulic oil discharged from the hydraulic pump 40 into the cylinder-to-boom connection switching cylinder 32*b* and the boom member connection switching cylinder 34*b*; and a flow passage switching valve 35*b* for switching the flow passage of the hydraulic oil discharged from the hydraulic hose 35*a* between the cylinder-to-boom connection switching cylinder 32*b* and the boom member connection switching cylinder 34*b*.

The hydraulic hose 35*a* is made of a flexible material and has a length that can supply the hydraulic oil to the cylinder-to-boom connection switching cylinder 32*h* and the boom member connection switching cylinder 34*b* while the telescopic cylinder 31 is maximally extended. The hydraulic hose 35*a* wound around the hose reel 35*c* is reeled out from the hose reel 35*c* as the telescopic cylinder 31 is extending, and is reeled off on the hose reel 35*c* as the telescopic cylinder 31 is contracting.

Figure 4:
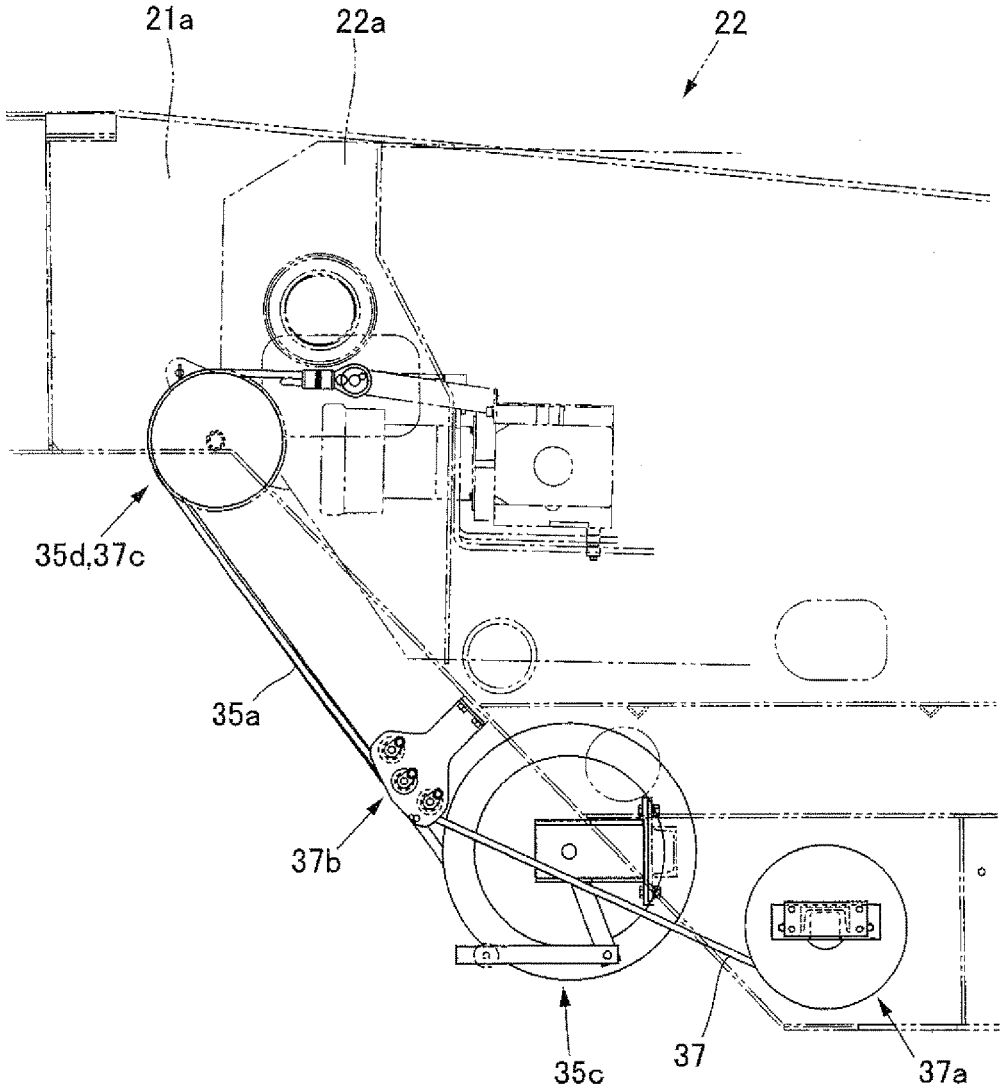
FIG. 4 is a side view showing a hose reel and a cord reel.
Figure 5:
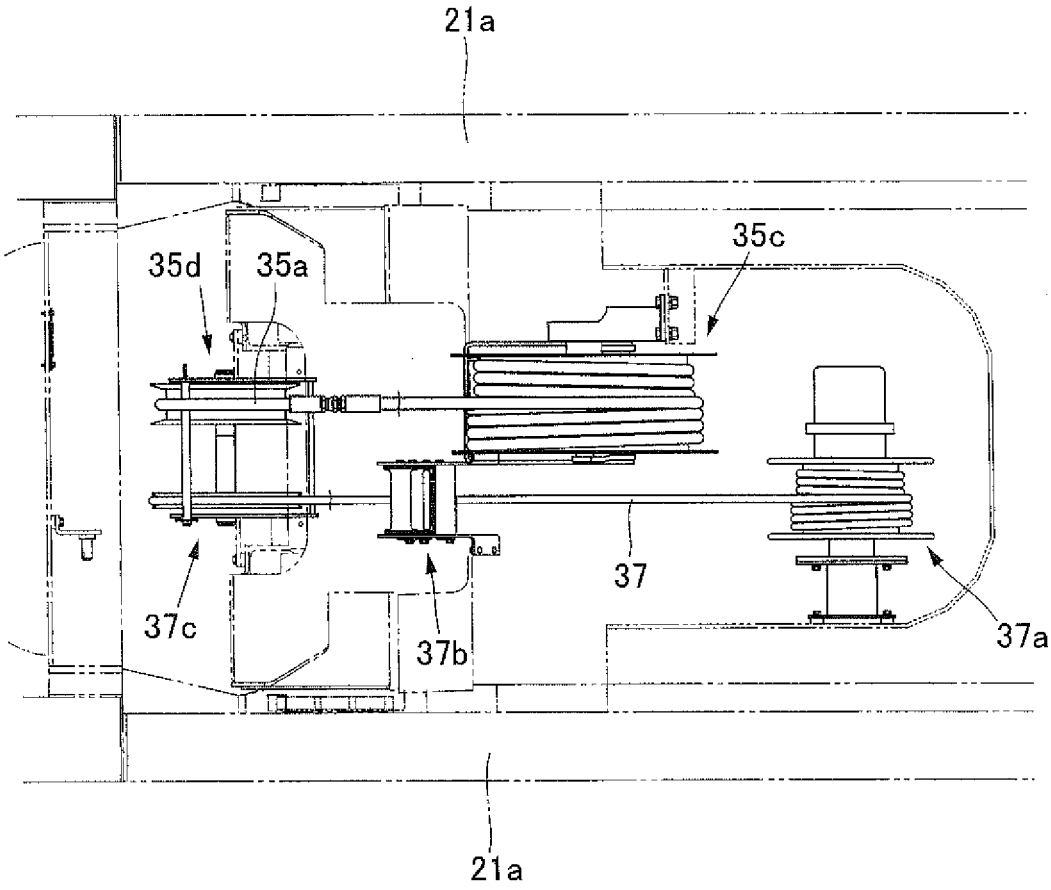
FIG. 5 is a top view showing the arrangement of the hose reel and the cord reel.
Figure 6:
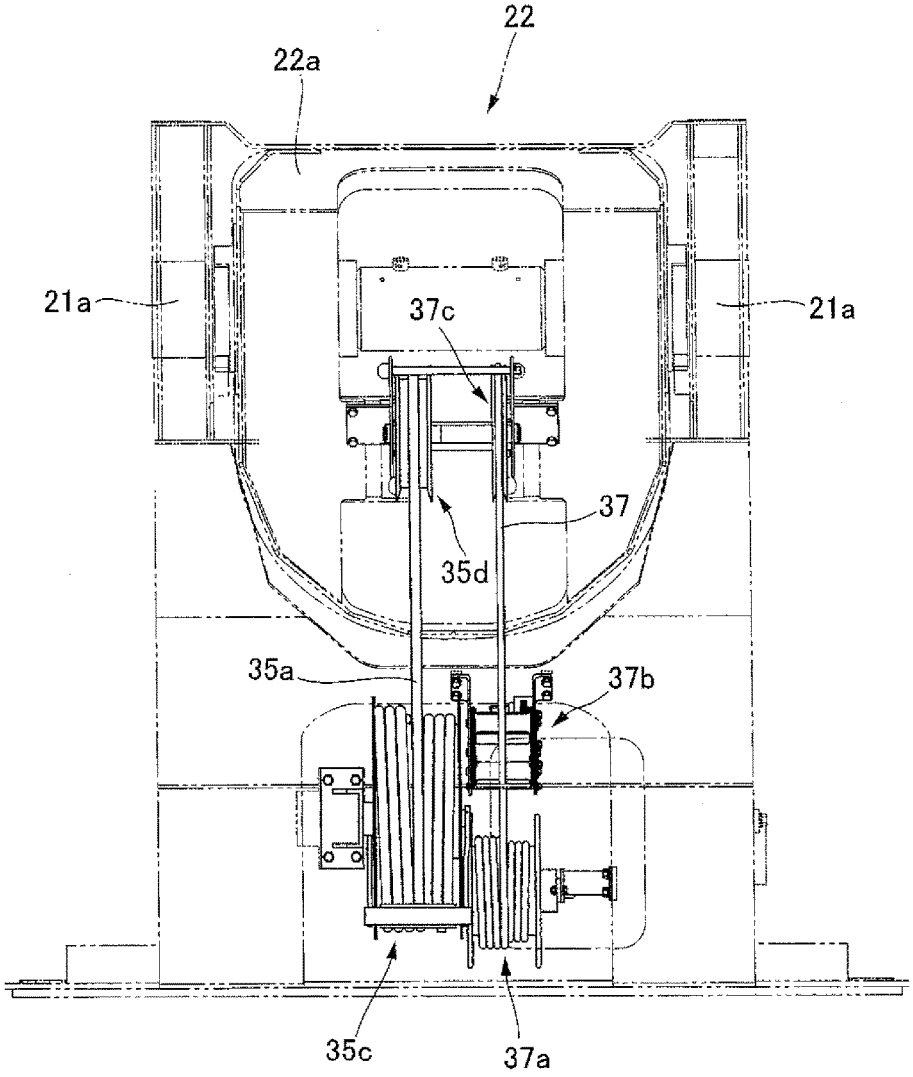
FIG. 6 is a back view showing the arrangement of the hose reel and the cord reel.

As shown in FIGS. 4 to 6, the hose reel 35*c* is mounted on the bracket 21*a* and located below the base end of the bottom boom member 22*a*. The hose reel 35*c* has a dimension in the direction of the rotating axis that allows the hydraulic hose 35*a* to be wound around the hose reel 35*c* in a single layer in the direction of the rotating axis and has a dimension in the radial direction that allows the hydraulic hose 35*a* to be wound around the hose reel 35*c* in layers outward in the radial direction. The hydraulic hose 35*a* wound around the hose reel 35*c* is guided by a first sheave 35*d* and extends to the cylinder-to-boom connection switching cylinder 32*b* and the boom member connection switching cylinder 34*b* side. The first sheave 35*d* is rotatably provided on the base end of the bottom boom member 22*a* located above the hose reel 35*c*.

As shown in FIG. 3, the boom extension and contraction mechanism 30 further includes a plurality of proximity switches 36 that detect which of the boom members 22*b*, 22*c*, 22*d*, 22*e*, and 22*f* is connected to the cylinder pins 32*a*, in order to detect the drive condition of the cylinder-to-boom connection switching cylinder 32*b* and the boom member connection switching cylinder 34*b*. These proximity switches 36 and a solenoid that drives the flow passage switching valve 35*b* are connected to a controller provided in, for example, the vehicle 10 via the cable 37. The cable 37 is constituted by a plurality of flexible signal lines and has a length that can reach the proximity switches 36 and the flow passage switching valve 35*b* while telescopic cylinder 31 is maximally extended. The cable 37 wound around the cord reel 37*a* is reeled out from the cord reel 37*a* as the telescopic cylinder 31 is extending, and is reeled off on the cord reel 37*a* as the telescopic cylinder 31 is contracting.

As shown in FIGS. 4 to 6, the cord reel 37*a* is mounted on the bracket 21*a* and located below the base end of the bottom boom member 22*a* and in front of the hose reel 35*c*. The cord reel 37*a* has a dimension in the direction of the rotating axis that allows the cable 37 to be wound around the cord reel 37*a* in a single layer in the direction of the rotating axis. The cable 37 wound around the cord reel 37*a* is guided by a roller guide 37*b* and a second sheave 37*c* and extends to the proximity switches 36 and the flow channel switching valve 35*b* side. The roller guide 37*b* is rotatably provided on the bracket 21*a* at a position behind and obliquely above the cord reel 37*a*. The second sheave 37*c* is rotatably provided on the base end of the bottom boom member 22*a* located above the roller guide 37*b* on the same axis as the first sheave 35*d*.

Here, the relationship between the hose reel 35*c* and the first sheave 35*d*, and the relationship between the cord reel 37*a* and the second sheave 37*c* have to satisfy so-called "fleet angle".

Figure 7:
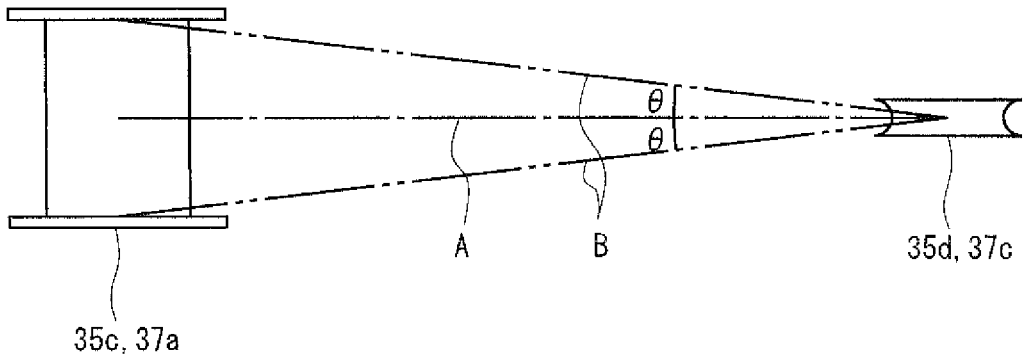
FIG. 7 is a drawing explaining the fleet angle.
Figure 8:
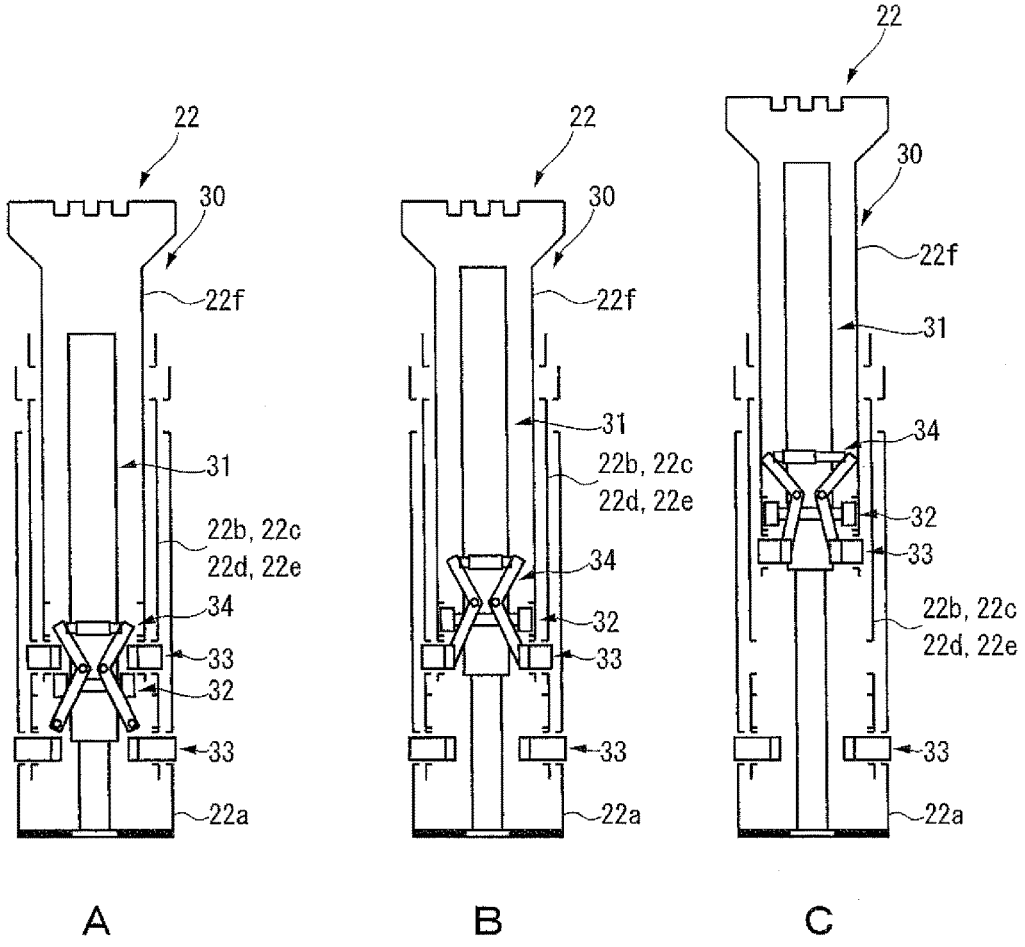
FIG. 8 is a schematic view showing the boom extending and contracting.

As shown in FIG. 7, the fleet angle means angle θ made by line A connecting the center of the sheave in the direction of the rotating axis and the center of the reel in the direction of the rotating axis and line B connecting the center of the sheave in the direction of the rotating axis and the inner surface of a flange in the direction of the rotating axis of the reel. With the present embodiment, the relationship between the positions of the hose reel 35*c* and the first sheave 35*d*, the relationship between the positions of the cord reel 37*a* and the second sheave 37*c*, and the dimensions of the hose reel 35*c* and the cord reel 37*a* in the direction of the rotating axis are determined such that the fleet angle is within two degrees.

With the boom extension and contraction mechanism for a crane apparatus having the above-described configuration, in order to extend the boom 22, the boom members 22*b*, 22*c*, 22*d*, 22*e* and 22*f* accommodated in the boom members 22*a*, 22*b*, 22*c*, 22*d* and 22*e* in back of them, respectively, are shifted in the order from the boom member 22*f* that is located in the front end side. Meanwhile, in order to contract the boom 22, the boom members 22*b*, 22*c*, 22*d*, 22*e* and 22*f* protruding from the boom members 22*a*, 22*b*, 22*c*, 22*d* and 22*e* in back of them, respectively, are shifted in the order from the boom member that is located in the base end side.

In order to extend and contract the boom 22, the boom extension and contraction mechanism 30 first supplies the cylinder-to-boom connection switching cylinder 32*b* with the hydraulic oil to release the cylinder pins 32*a* from engaging the boom member and then drive the telescopic cylinder 31 (see FIG. 8A). Next, the boom extension and contraction mechanism 30 shifts the cylinder pins 32*a* to the position at which the cylinder pins 32*a* face the cylinder pin engagement parts 32*c* of the boom member intended to be shifted by driving the telescopic cylinder 31, and stops supplying the hydraulic oil to the cylinder-to-boom connection switching cylinder 32*b* to release the cylinder pins 32*a* from disconnecting from the boom member. As a result, the cylinder pins 32*a* engage the cylinder pin engagement part 32*c* for the boom member intended to be shifted (see FIG. 8B). After the cylinder pins 32*a* have engaged the cylinder pin engagement parts 32*c*, the boom extension and contraction mechanism 30 disconnects between the boom member to be shifted and the next boom member in the base end side by supplying the boom member connection switching cylinder 34*b* with the hydraulic oil. In this state, the boom extension and contraction mechanism 30 drives the telescopic cylinder 31 to allow the boom 22 to extend and contract (see FIG. 8C). After having shifted the intended boom member to a predetermined position, the boom extension and contraction mechanism 30 stop supplying the boom member connection switching cylinder 34*b* with the hydraulic oil, and connect the shifted boom member to the next boom member in the base end side.

As described above, the boom extension and contraction mechanism for a crane apparatus according to the present embodiment includes: a hydraulic hose 35*a* configured to supply hydraulic oil from the swivel base side 21 to the cylinder-to-boom connection switching cylinder 32*b* and the boom member connection switching cylinder 34*b*; a flow passage switching valve 35*b* configured to switch the flow passage of the hydraulic oil supplied via the hydraulic hose 35*a* between the cylinder-to-boom connection switching cylinder 32*b* side and the boom member connection switching cylinder 34*b* side; a hose reel 35*c* configured to reel out the hydraulic hose 35*a* as the telescopic cylinder 31 is extending, and reel off the hydraulic hose 35*a* as telescopic cylinder 31 is contracting; a cable 37 used to supply power from the swivel base 21 side to the solenoid for driving the flow passage switching valve 35*b* and to transmit signals from the proximity switches 36 to the swivel base 21 side; and a cord reel 37*a* configured to reel off the cable 37 as the telescopic cylinder 31 is extending and to reel off the cable 37 as the telescopic cylinder 31 is contracting. The hose reel 35*c* and the cord reel 37*a* are arranged on the swivel base 21 in the direction in which the boom 2 extends and contracts. By this means, it is possible to increase the dimension of the hose reel 35*c* in the direction of the rotating axis while reducing the dimension of the hose reel 35*c* in the radial direction. Therefore, it is possible to reduce the length over which the hose reel 35*c* protrude from the back of the swivel base 21, and consequently to reduce the angle of traverse in the back of the swivel base 21 with a simple structure. Moreover, it is possible to place the hydraulic hose 35*a* and the cable 37 near one another and extend them to the cylinder tube 31*a* side, and therefore to reduce the size of the boom 22 in the width direction.

Here, with the present embodiment, a configuration has been described where the boom extension and contraction mechanism according to the present invention is applied to a mobile crane. However, it is by no means limiting, but the boom extension and contraction mechanism according to the present invention is applicable to a fixed crane apparatus.

The invention claimed is:

1. A boom extension and contraction mechanism for a crane apparatus comprising:

a boom including a plurality of boom members, the boom extending and contracting by shifting next boom members in front of respective ones with respect to the boom members other than a top boom member;

a base configured to support a base end of a bottom boom member;

a telescopic cylinder including a cylinder rod and a cylinder tube, one of the cylinder rod and the cylinder tube being connected to the bottom boom member to extend and contract the boom;

a cylinder-to-boom connection mechanism configured to be able to connect and disconnect between the other of the cylinder rod and the cylinder tube and the boom members other than the bottom boom member;

a boom member connection mechanism configured to be able to connect between the boom members next to one another and release the boom members from being connected to one another;

a cylinder-to-boom connection switching cylinder configured to allow the cylinder-to-boom connection mechanism to perform one of a connecting operation and a disconnecting operation between the telescopic cylinder and a boom member by supplying hydraulic oil, and to allow the cylinder-to-boom connection mechanism to perform the other of the connecting operation and the disconnecting operation between the telescopic cylinder and the boom member by stopping supplying the hydraulic oil;

a boom member connection switching cylinder configured to allow the boom member connection mechanism to perform one of a connecting operation and a disconnecting operation between the boom members next to one another by supplying the hydraulic oil, and to allow the boom member connection mechanism to perform the other of the connecting operation and the disconnecting operation between the boom members next to one another by stopping supplying the hydraulic oil;

only one hydraulic hose configured to supply the hydraulic oil from the base side to the cylinder-to-boom connection switching cylinder and the boom member connection switching cylinder;

a flow passage switching mechanism configured to switch a flow passage of the hydraulic oil supplied via the hydraulic hose between the cylinder-to-boom connection switching cylinder side and the boom member connection switching cylinder side;

a hose reel configured to reel out the hydraulic hose as the telescopic cylinder is extending, and to reel off the hydraulic hose as the telescopic cylinder is contracting, the hose reel having a dimension in a direction of a rotating axis that allows the hydraulic hose to be wound around the hose reel in the direction of the rotating axis;

a cable used to supply power from the base side to equipment provided in the other of the cylinder rod and the cylinder tube of the telescopic cylinder, and to transmit a signal from the equipment to the base side; and a cord reel configured to reel out the cable as the telescopic cylinder is extending and to reel off the cable as the telescopic cylinder is contracting, the cord reel having a dimension in the direction of the rotating axis that allows the cable to be wound around the cord reel in the direction of the rotating axis, wherein the hose reel and the cord reel are arranged on the base in a direction in which the boom extends and contracts.

* * * * *